US007160244B2

(12) United States Patent
Westerkull

(10) Patent No.: US 7,160,244 B2
(45) Date of Patent: Jan. 9, 2007

(54) ARRANGEMENT FOR A HEARING AID

(76) Inventor: Patrik Westerkull, Hovashagstig 26A, 436 54 Hovas (SE)

( * ) Notice: Subject to any disclaimer, the term of this patent is extended or adjusted under 35 U.S.C. 154(b) by 347 days.

(21) Appl. No.: 10/842,317

(22) Filed: May 10, 2004

(65) Prior Publication Data

US 2005/0249366 A1 Nov. 10, 2005

(51) Int. Cl.
*H04R 25/00* (2006.01)

(52) U.S. Cl. ..... 600/25

(58) Field of Classification Search ..... 600/25; 381/151, 326; 623/18.12; 606/54, 72, 73, 606/75, 130; 285/307, 321, 413–415; 403/348, 403/339, 508, 509, 913; 411/338, 339
See application file for complete search history.

(56) References Cited

U.S. PATENT DOCUMENTS 4,498,461 A * 2/1985 Hakansson ..... 600/25
5,916,164 A * 6/1999 Fitzpatrick et al. ..... 600/426
5,935,170 A 8/1999 Hakansson
6,547,715 B1 * 4/2003 Muller et al. ..... 600/25

* cited by examiner

*Primary Examiner*—Samuel G. Gilbert
(74) *Attorney, Agent, or Firm*—Rolf Fasth; Fasth Law Offices

(57) ABSTRACT

The arrangement is for controlling the connection for a hearing aid (15) with a fixture (13) anchored in the skull bone. A control arm (1) extends from a connector (17), disposed between the hearing aid (15) and an abutment (9), to a handle (3) disposed at a side of the hearing aid (15) where the handle (3) is reachable by a patient. Biasing means provides a biasing force for biasing the control arm towards the connector (17). The control arm (1) is in operative engagement with the biasing means and movable in a direction to counter-act the biasing force of the biasing means to release the abutment (9) from the connector (17).

17 Claims, 15 Drawing Sheets

ARRANGEMENT FOR A HEARING AID

TECHNICAL FIELD

The present invention relates to an arrangement for controlling a connection between a bone anchored implant and a bone conduction hearing aid.

BACKGROUND OF THE INVENTION

Bone anchored hearing aids are essential for the rehabilitation of patients suffering from some specific type of hearing losses for which traditional hearing aids are insufficient. This type of device consists of an external hearing aid with a vibrating transducer which is connected via a coupling to a skin penetrating abutment mounted on a fixture anchored in the skull bone. It is important that the coupling is sufficiently firm to avoid poor transmission of the vibrations but it is also important that the coupling is not too firm since it is also important that the hearing aid falls off in case of a sudden impact to avoid that the skull bone anchoring is damaged. In a coupling like this there is always coupling forces pressing components in the connection against the abutment. The coupling forces can be generated by a separate spring, a flexible material or by a magnet. The patient takes on and off the hearing aid daily so wear and tear durability of the coupling is also important.

Patents such as U.S. Pat. No. 5,735,790, U.S. Pat. No. 4,498,461 SE 89032718 and SE0102207 describe couplings where the force when connecting and disconnecting the hearing aid is quite high since it is important that the hearing aid is firmly coupled to the abutment. Especially it is not possible for the patient to use the hearing aid at all during the time it takes for the fixture in the skull bone to integrate with the skull bone, which takes around 3–6 months. The patients need to come to the hospital three times, first for the fixture insertion, then after a week to remove a healing cap and some gauze around the abutment and then after 3–6 months for the hearing aid fitting. If any of the couplings in U.S. Pat. No. 5,735,790, U.S. Pat. No. 4,498,461 SE 89032718 or SE0102207 would be used by the patient during the healing time, the fixture would most likely not integrate with the skull bone and come loose, due to the high load on the fixture when connecting and disconnecting the hearing aid. Arrangements, like the one described in SE503790, have several disadvantages and are not a solution to this since they do not at all reduce the force when connecting the hearing aid and when disconnecting the devices a significant rotation force is generated which is not desirable since the fixture in the bone is often screw shaped. A rotation of the fixture would definitely hinder the integration in the bone.

The high load on the connection also limits the lifetime of the hearing aid. In the hearing aid especially the vibrating transducer and the transducer suspension are affected by and worn out by the high forces when taking the hearing aid on and off. A limitation of the current systems is also that it is not possible to do more powerful devices since especially for high frequencies there is distortion of the sound due to the limited coupling force available in the current designs. If the coupling force could be significantly higher than in the current systems also more powerful devices for patients with more severe hearing losses could be rehabilitated with this type of hearing aid. In spite of the fact that bone anchored hearing aids have been available since more than 15 years ago, the above mentioned drawbacks remain. There is a need to provide a solution to the above outlined problems and drawbacks.

SUMMARY OF THE INVENTION

The arrangement of the present invention provides an efficient solution to the problems with the current designs of bone anchored hearing aid couplings. More specifically, the arrangement of the present invention includes a mechanical control arm system where the coupling force is counteracted in a way that the connection and disconnection of the hearing aid can be done without any force loading the fixture and the abutment. In this way, it is possible for the patient to start to use the hearing aid before the fixture is fully integrated in the bone which takes around 3–6 months, hence the patient will be rehabilitated much quicker. If the fitting is done in conjunction with the insertion of the fixture also a lot of costs for both patients and the health care system can be saved since this means the patients, who might have to travel long distances to the hospital, do not need to come back for an extra appointment to do the hearing aid fitting. The arrangement of the present invention also provides advantages for patients having a poor fixation of the fixture in the skull due to for example poor bone quality where the arrangement of the present invention can offer a minimal stress on the fixture in the bone. Another patient group in need for the arrangement of the present invention is small children where the skull bone is very soft. There are also patients who would prefer a coupling with control arms simply because they do not feel comfortable with the high forces that need to be applied when taking the device on and off. If the control arm system is used this will not only lower the stress on the fixture and the abutment but also on the hearing aid, hence the hearing aid will last longer. The control arm extends from a handle to the connection and transfers the force from the patients' fingers to the connection where the force is used for counteracting a coupling force in the connection. The arrangement of the present invention can have one or more control arms. The biasing means, generating the coupling force and/or counteracting the force on the handle on the control arm, may, for example, be a spring, an O-ring, a magnet or a flexible material.

The control arm extends from the center of the connection to the side of the hearing aid where the handle can be easily reached by the patient's fingers. The control arm can be connected to different types of connector principles. The connector has at least one coupling shoe which is in contact with the abutment when the hearing aid is connected to the abutment.

In a preferred embodiment, the control arm is connected to a connector with flexible coupling shoes. In another preferred embodiment the control arm is connected to a connector with a coupling shoe that is pressed against the abutment by a spring. The coupling shoes in both these two preferred embodiments can go either inside of the abutment where a coupling force from the connector is at least partly acting radially outwardly against the inside of the abutment, or the coupling shoes can go on the outside of the abutment where a coupling force from the connector is at least partly acting radially inwardly against the outside of the abutment.

In case of a flexible coupling shoe the control arm may be connected to the flexible coupling shoe either directly or through for example a wedge-like portion, in such a way that the force applied on the handle counteracts the coupling force. If the coupling shoe is pressed against the abutment by a spring the control arm may either be connected to the coupling shoe or to the spring. The connection to the coupling shoe or the spring may then be either direct or through for example a wedge-like portion, in such a way that the force applied on the handle counteracts the coupling force.

In a preferred embodiment the control arm, the handle and the coupling shoes are manufactured in one piece which include a plastic material.

In a preferred embodiment the control arm is connected to a magnetic connector where the coupling force is generated by a magnet in either of the abutment and the connector. In case of a magnetic interaction between the connection and the abutment the control arm can form a separating portion, for example a wedge, which presses the connector and the abutment apart when a force is applied to the handle on the control arm.

In case of a magnetic interaction between the connection and the abutment another preferred embodiment includes a sleeve on the connector that goes either around the outside of the abutment or inside of the abutment to avoid the magnetic coupling shoe from sliding off the abutment in radial direction. Without the connector sleeve a significantly stronger magnet would have been required to prevent the hearing aid from falling off. In this arrangement the control arm can be connected to the coupling sleeve. The coupling sleeve is moved in lateral direction in such a way that the magnetic coupling shoe can be moved freely in radial direction in relation to the abutment when a force is applied on the handle. By sliding the magnetic connector in radial direction the forces on the fixture may be significantly reduced compared to when pulling the connector away from the abutment in lateral direction. This arrangement only limits the force when disconnecting the abutment from the connector and does not limit the force when connecting the abutment to the connector. This may however be a cost efficient and sufficiently good arrangement for some patients.

The control arm may for example also be connected to a connector where the coupling force is generated by a spring on the abutment which presses the coupling shoe against the abutment. The control arm can then be designed in such a way that the control arm forms a wedge on the connector pressing the connector and the abutment apart when a force is applied to the handle on the control arm.

A preferred embodiment with only one control arm can be a cost efficient version of the arrangement of the present invention. However, with only one handle the patient needs to counteract the force on the handle by a force on the hearing aid. In that way, the suspension system of the vibrating transducer in the hearing aid may have to take up some of these forces. Therefore a preferred embodiment is a design with two control arms where the force on one of the arms can be counteracted by a force on the other control arm.

The control arm may also be connected to the connection in such a way that the control arm forms a wedge on the connector pressing the connector and the abutment apart when a force is applied to the handle on the control arm. This arrangement may be applied for any of the connector types mentioned above. However for most coupling designs this arrangement only limits the force when disconnecting the abutment from the connector and does not limit the force when connecting the abutment to the connector. This may however be a cost efficient and sufficiently good arrangement for some patients.

In a preferred embodiment the control arms are connected to a connector mounted on the hearing aid. If the patient needs to use the control arms during a longer period this is a good solution. However, if the patient just needs control arms during a shorter period it may be advantageous if the control arms can be removed. A preferred embodiment of the arrangement of the present invention includes a control arm interconnection. The control arm interconnection can be a mechanical coupling or an indication of fracture on the control arm where it can be disconnected or cut off when there is no more need for a control arm.

In a preferred embodiment the control arms are connected to a connector mounted on a healing interconnection unit which lateral side can be connected to the hearing aid. If the patient needs to use control arms to avoid loading the fixture in the bone during the healing period, the patient can then use the healing interconnection unit equipped with control arms and then when the fixture is integrated with the skull bone the healing interconnection unit can be removed from the hearing aid and the patient can take on and off the hearing aid without using any control arms. The connection on the healing interconnection unit can be any of the connector types mentioned above. If the abutment allows connection to it in two ways, for example both on the inside and the outside of the abutment, the connection on the healing interconnection unit does not necessarily have to be the same type of connector as the connector on the hearing aid that connects to the lateral side of the healing interconnection unit.

To use the hearing aid also during the first week when the gauze around the abutment needs to be held in place with a healing cap. A preferred embodiment includes a healing cap which lateral side has an abutment similar interface which may be connected to the connector on a healing interconnection unit or on a hearing aid, and where the other end of the healing cap can be connected to the abutment. The connection on the healing cap may be any of the connector types mentioned above.

An alternative healing cap design is a healing cap that may be connected to the outside of the abutment and where the abutment can go through the healing cap which would then offer an access to the abutment in such a way that the abutment may be connected to the connector on a healing interconnection unit or on a hearing aid also when the healing cap is mounted on the abutment.

In a preferred embodiment the distance between the handle and the center point of the connector is greater than 4 millimeters but less than 40 millimeters. If this distance is too short it will be difficult to reach the handles and if it is too long it might be bulky and not aesthetically pleasing. Of course, the control arms may be longer or shorter as needed.

For any off the above arrangements several different designs of a control arm is possible. Specifically the control arm can also be designed as a turning wheel. One practical advantage of the wheel design is that the user is less likely to inadvertently turn the handle by hitting something since there is no protruding part. The wheel is also symmetrical so that it is suitable both for left and right ears.

DETAILED DESCRIPTION

Figure 1:
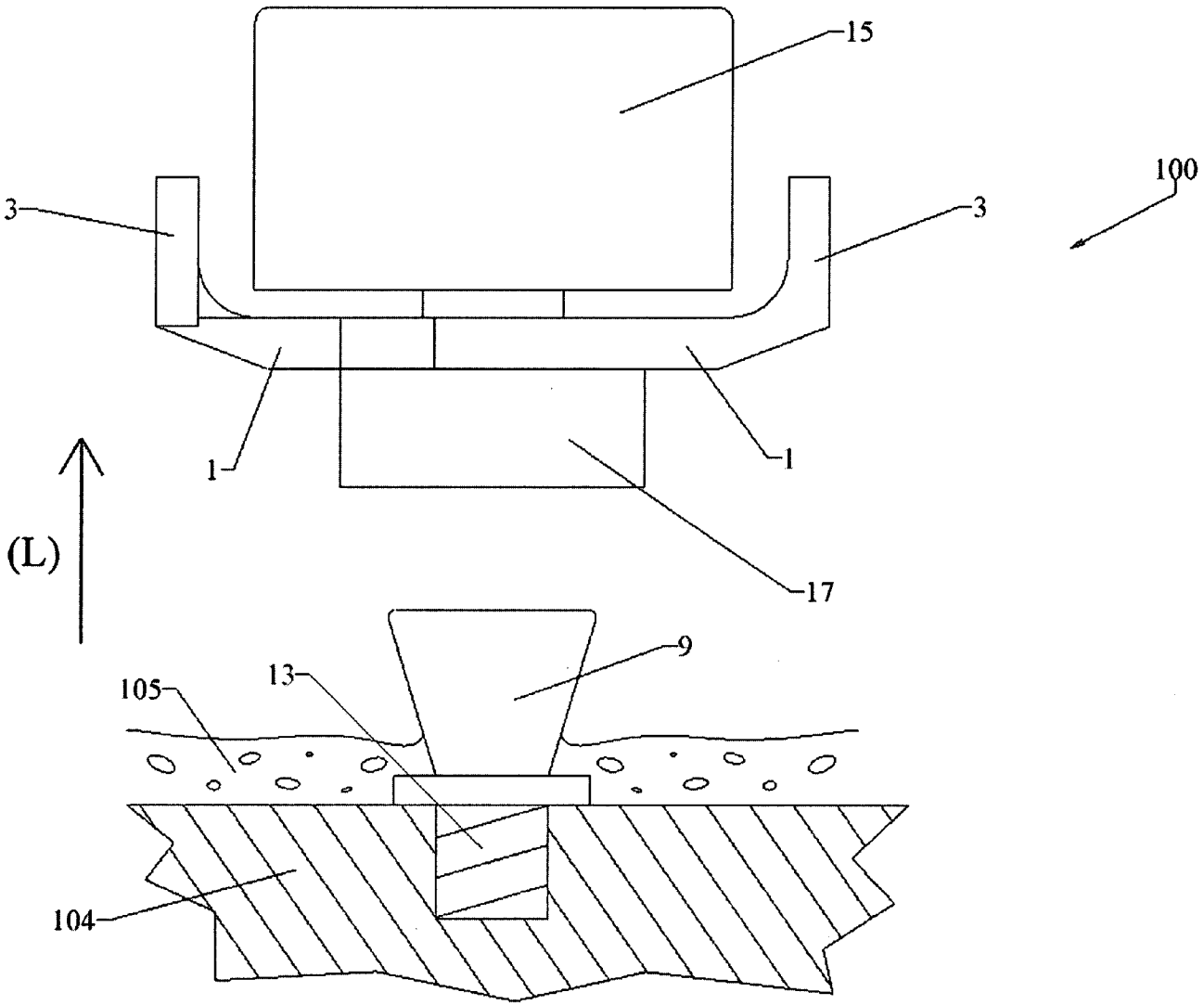
FIG. 1 is a side view of an arrangement with control arms on a connector between an abutment and a hearing aid.

In FIG. 1 a preferred embodiment of the arrangement 100 of the present invention is shown where the control arms 1 have handles 3 that are connected to a connector 17 that in turn is connected to a hearing aid 15. By pressing the handles 3 against each other a force is transferred by the control arms 1 to the connection where this force is counteracting the coupling force. In this way, the connector 17 can easily be connected to and disconnected from the abutment 9. The abutment 9 goes through the skin 105 and is fixated to a fixture 13 which is anchored in the bone 104. The arrow in FIG. 1 indicates a lateral direction (L).

Figure 2:
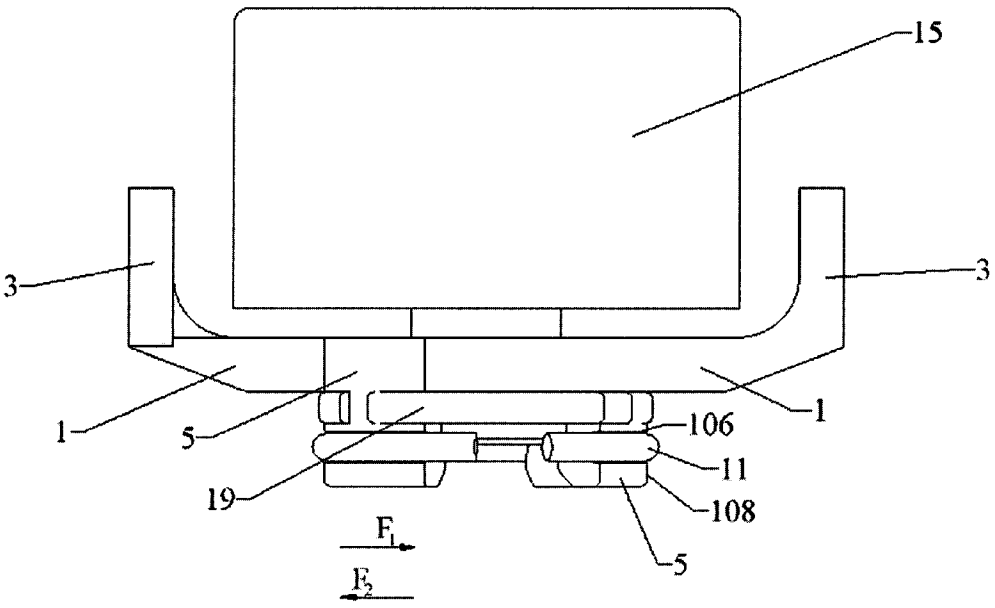
FIG. 2 is a side view of a coupling on the hearing aid where the connection can attach on the outside of the abutment and where the control arms are connected to the coupling shoes of the connection.
Figure 2:
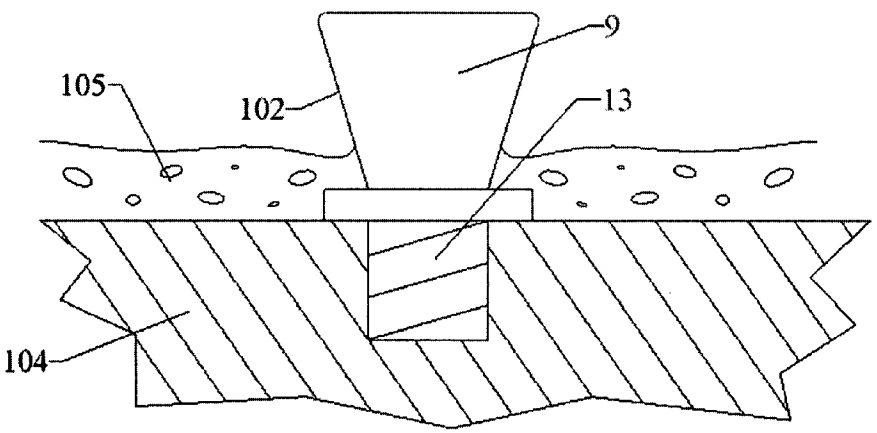

In FIG. 2 a preferred embodiment of the arrangement of the present invention is shown where the control arms 1 have handles 3 that are connected to coupling shoes 5 and where the coupling shoes 5 may be pressed against an outside 102 of the abutment 9 with the aid of a circular spring 11 that is disposed in a groove 106 defined in an outside 108 of the coupling shoes 5 and provides an radial biasing force (F1) directed inwardly to hold and bias the coupling shoes 5 against a connector plate 19. The connector plate 19 projects through openings 110 (best seen in FIG. 3) defined in the coupling shoes 5. The abutment 9 is mounted on a fixture 13 which may be attached to a skull bone 104 of a patient 106. By pressing the handles 3 against each other against the inward radial biasing force (F1) of the spring 11, an outward radial force (F2) is transferred by the control arms 1 to the connection where this force (F2) is counteracting the coupling force (F1) generated by the spring 11. When the outward force (F2) is greater than the inward force (F1), the shoes 5 are separated to expand an opening defined between the shoes 5 so that the opening is greater than the largest diameter of the abutment 9. In this way, the hearing aid 15 can be connected and disconnected from the abutment 9 without loading the fixture 13.

Figure 3:
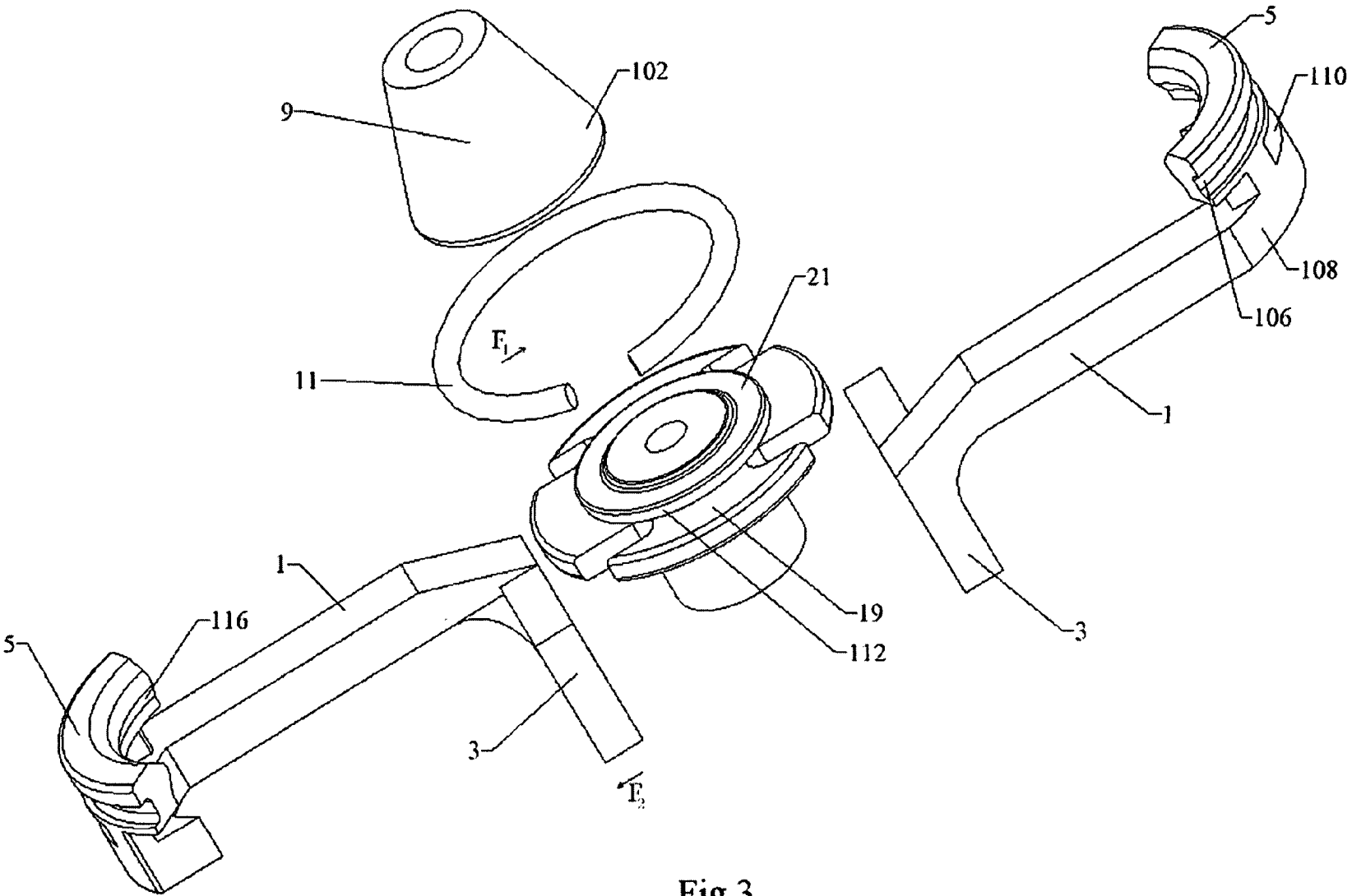
FIG. 3 is an exploded perspective view of the components of the connection and the abutment of the coupling in FIG. 2.

FIG. 3 shows the separated components of the connector 17 and the abutment 9 in the coupling in FIG. 2. The connector 17 has a connector plate 19, the spring 11 and the coupling shoes 5. The control arms 1 connect the handles 3 to the coupling shoes 5 of the connector 17. The contact surface 21 of the connector plate 19 where the connector plate is pressed against the abutment is also shown in FIG. 3. When the outward force (F2) is removed, the force (F1) of the spring urges the shoes 5 together again until an inner surface 116 of the shoes 5 bears against a radial contact surface 112 of the connector plate 19.

Figure 4:
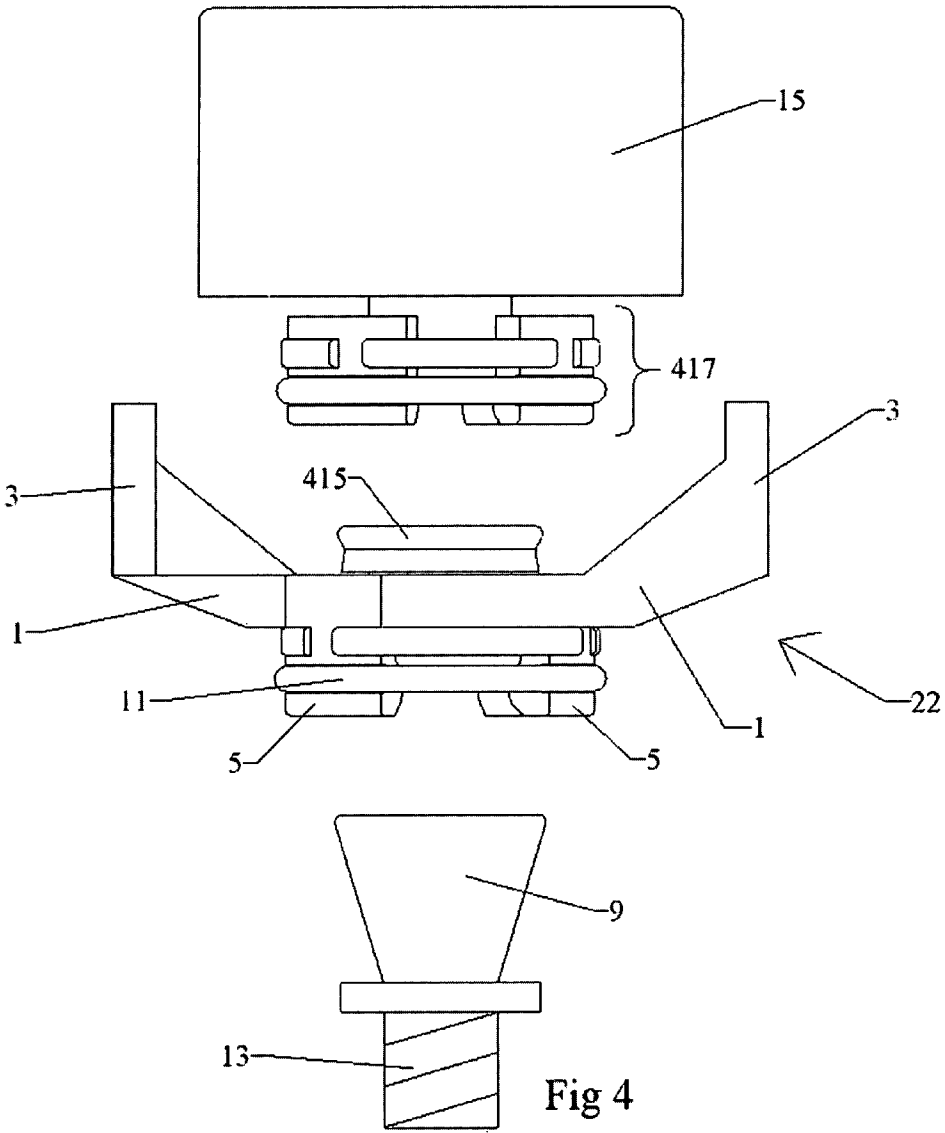
FIG. 4 is a side view of the same type of connection with control arms as in FIG. 2 but here the connection with control arms is part of a healing interconnection unit.

FIG. 4 shows a preferred embodiment with a similar coupling as the one described in FIG. 2 but where the control arms 1 are directly connected to a connection on a healing interconnection unit 22 to which the hearing aid 15 can be connected on the lateral side and which can be connected to the abutment 9 on the other side. The healing interconnection unit has an abutment similar interface 415 on its lateral side. The connector 417 without control arms on the hearing aid can be connected to either the abutment or the healing interconnection unit. The unit 22 may be modified to include any other type of connector on its contra lateral side and any type of abutment similar interface on the lateral side, dependent on which type of coupling is used to connect the hearing aid 15 to the abutment 9.

Figure 5:
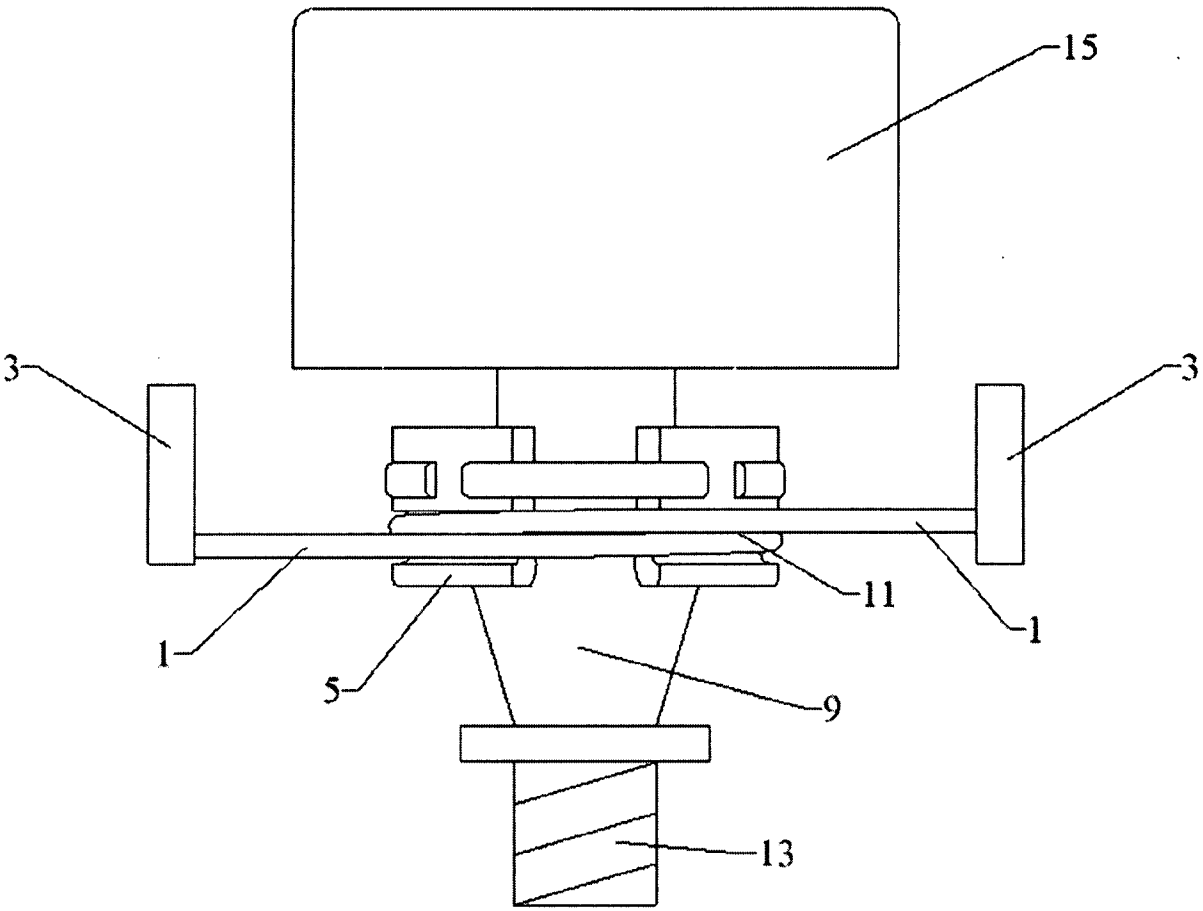
FIG. 5 is a side view of a coupling similar to the one described in FIG. 2 but where the control arms are connected to the spring that generates the coupling force.

FIG. 5 shows a preferred embodiment with a similar coupling as the one described in FIG. 2 but where the control arms 1 are directly connected to the circular spring 11. In this case, the control arms 1 have been manufactured by an extension of the material in the spring 11. By pressing the handles 3 against each other the coupling force generated by the spring 11 is counteracted and the hearing aid 15 can easily be connected and disconnected.

Figure 6:
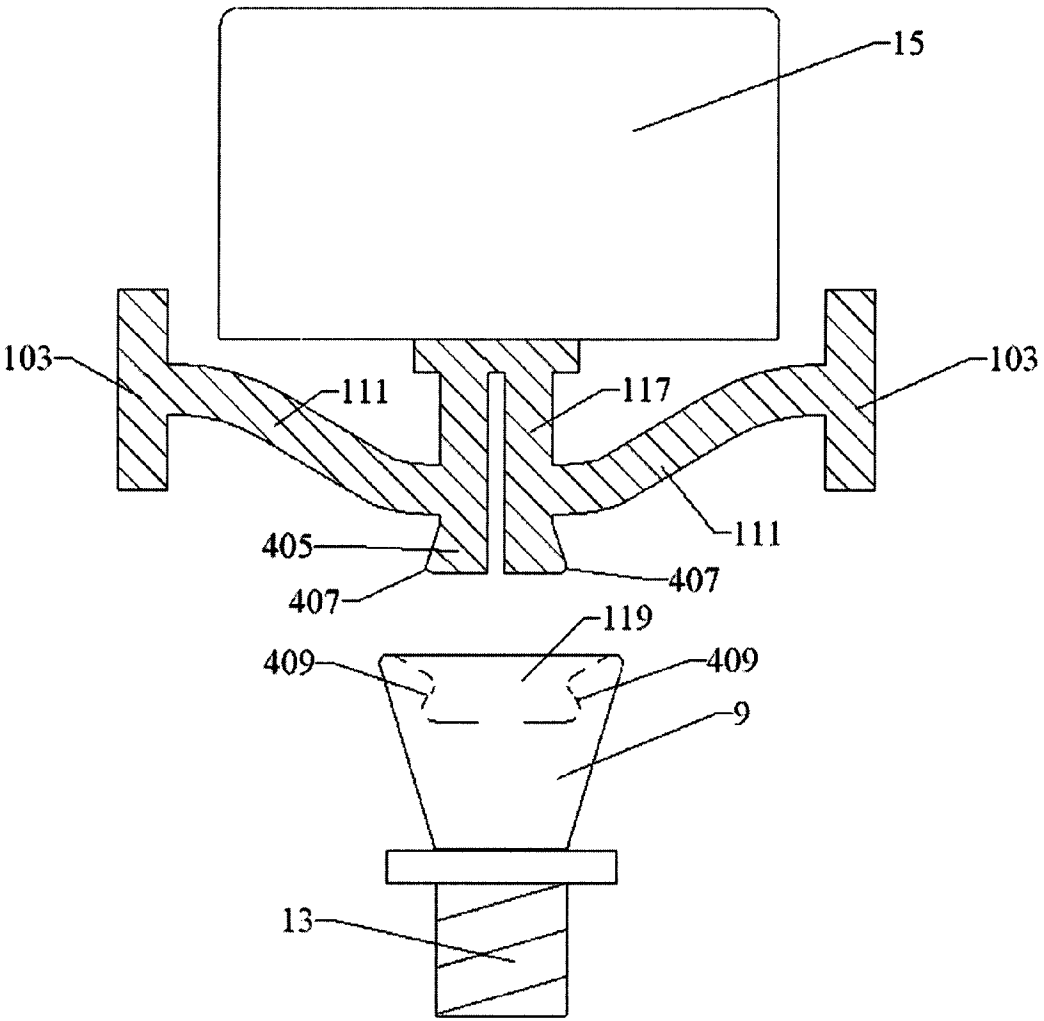
FIG. 6 is a side view of control arms on a flexible connector that can go inside of the abutment.

FIG. 6 shows a preferred embodiment where the control arms 111 are connected to a flexible connector 117 which is connected to the inside of a female portion 119 on the lateral side of the abutment 9. The control arms 111 have handles 103. When the flexible connector 117 is seated in the abutment 9 the connector is pressed together inwardly against a biasing force of the connector 117. Since the connector 117 is flexible the coupling shoe portion 405 on the connector presses outwardly on the inside of the female portion 119 of the abutment thus keeping it in place so that the protruding sections 407 of the portion 405 is urged against corner portions 409 of the female portion or cavity 119. When the handles 103 are pressed together the connector 117 is further pressed together and the hearing aid 15 can easily be connected or disconnected from the abutment 9 without loading the fixture 13.

Figure 7:
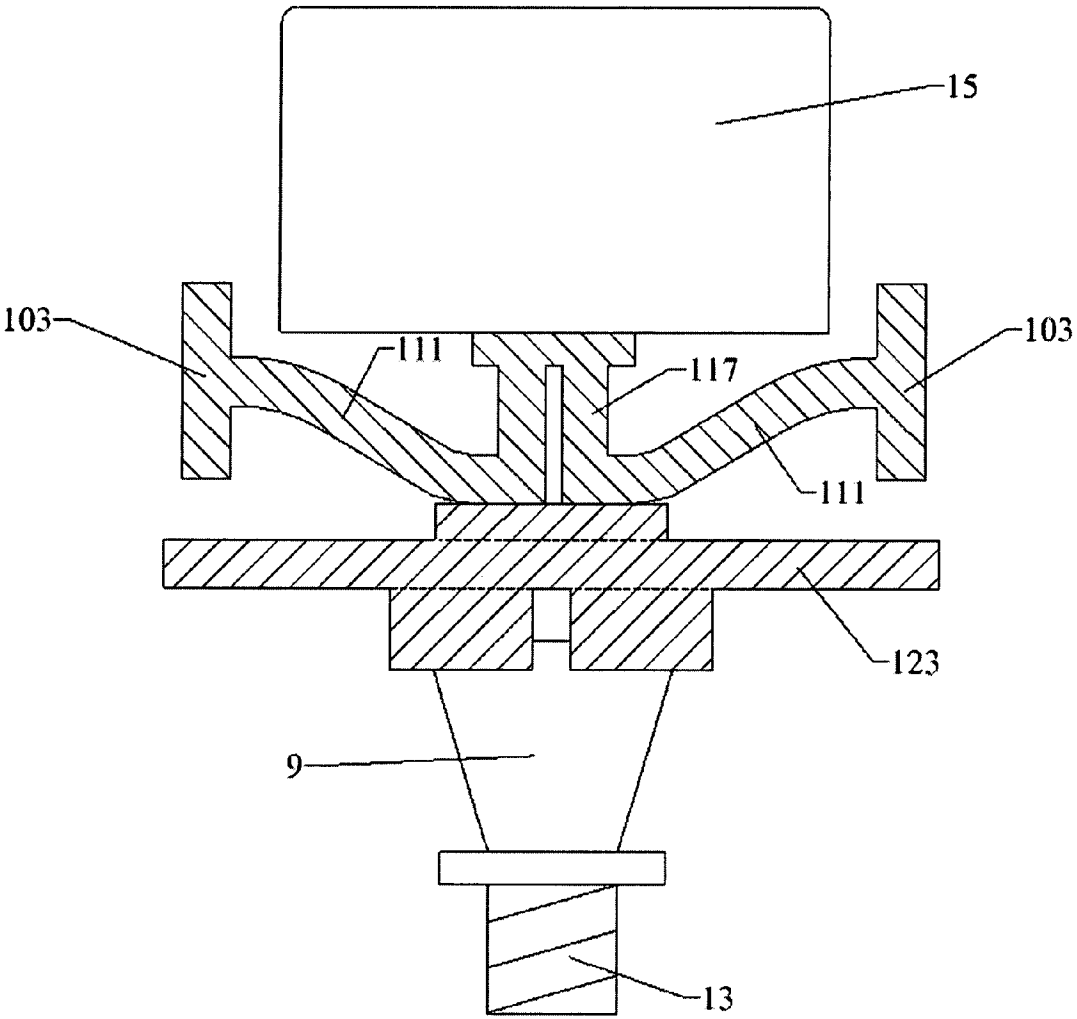
FIG. 7 is a side view of the same connection as in FIG. 6 but here the connector is connected to the inside of a healing cap which is then connected to the outside of the abutment and where the abutment inside has a seating for the flexible connector.

FIG. 7 shows a similar arrangement as the arrangement shown in FIG. 6 but here the flexible connector 117 is connected to the inside of a female portion on the lateral side of a healing cap 123 that in turn is attached to the abutment 9. The control arms 111 have handles 103. The circular healing cap 23 is connected to the outside of the abutment 9. The abutment 9 has a female portion inside so the flexible connector 117 can be directly connected to the abutment when the healing cap 123 has been removed. In this way the hearing aid 15 with control arms 111 can be used together with a healing cap 123 during the first week of healing and then the healing cap 123 can be removed and the connector 117 can be connected directly to the abutment 9 during the rest of the healing period. Of course, the healing cap 123 could be designed to connect to the inside of the abutment 9 instead but this might have resulted in a higher profile of the arrangement.

Figure 8:
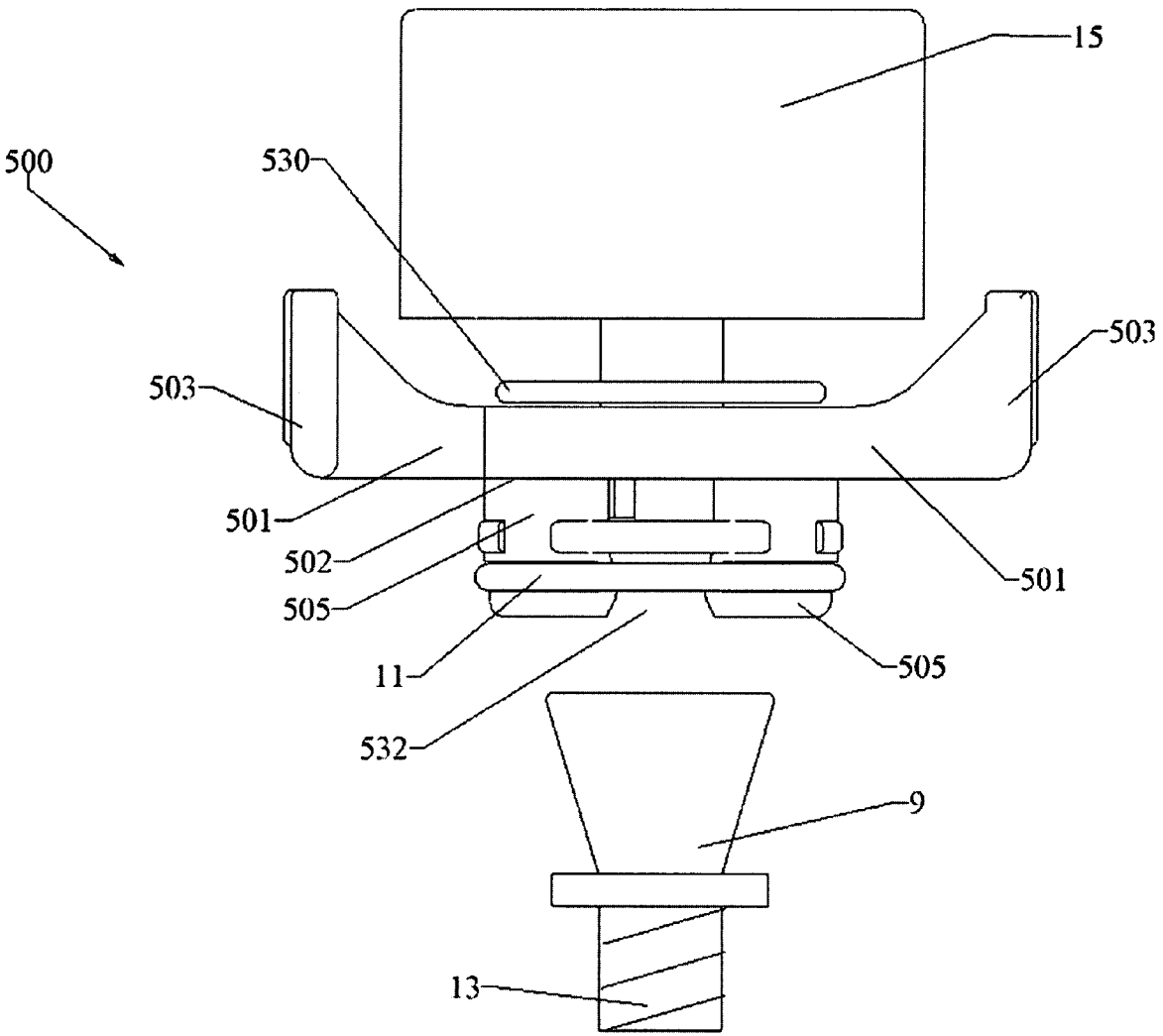
FIG. 8 is a side view of a similar arrangement as in FIG. 2 but where the control arm can be disconnected from the coupling shoe through a control arm interconnection.

FIG. 8 is a side view of an arrangement 500 which is similar to the arrangement shown in FIG. 2 but where the control arm 501 can be disconnected from the coupling shoe 505 through a control arm interconnection 502. The abutment 9 may be inserted through an opening 532 by pressing the handles 503 towards one another to widen the opening 532 against the biasing means of the spring 11, as described in more detail above.

Figure 9:
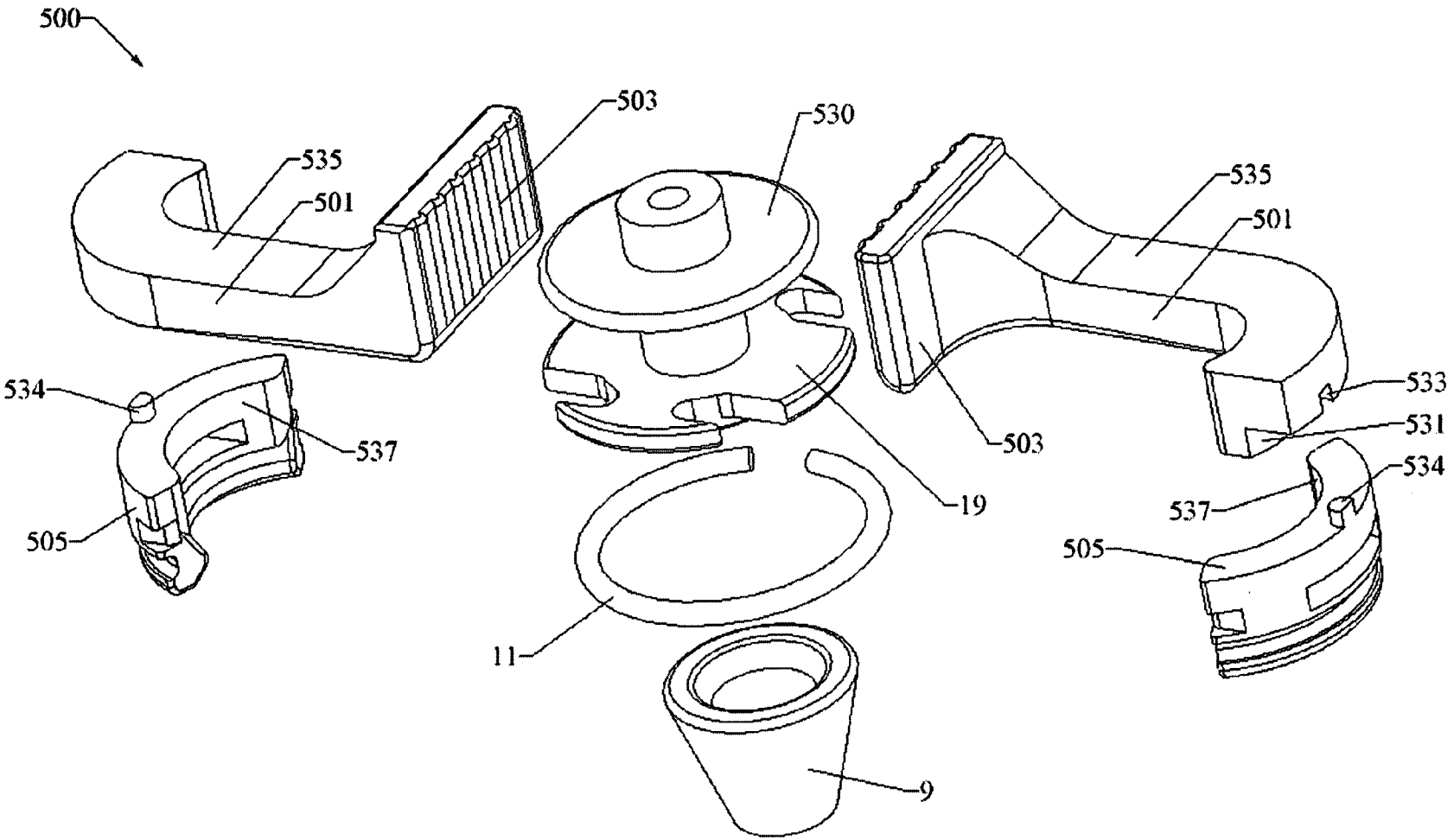
FIG. 9 is an exploded perspective view of the components of the connection and the abutment of the coupling in FIG. 8.

FIG. 9 is an exploded perspective view of the components of the connection and of the abutment 9 in the arrangement 500 in FIG. 8. An important feature of the arrangement 500 is that the arms 501 are removable from the shoes 505 so that the user may simply remove the arms 501 when the fixture healing is completed. This feature may also make the manufacturing less expensive compared with having a healing interconnection unit as described in FIG. 4. The control arm 501 has a contact surface 531 resting against an inner surface 537 of the coupling shoe 505. The control arm 501 has also a locking slot 533 into which a locking peg 534 on the coupling shoe 505 can be seated. In this way, the surface 531 is urged against the inside surface 537. The control arm 501 has also an upper surface 535 resting against a connector flange 530. These interfaces together form the control arm interconnection 502. The control arms 501 may be removed by first removing the spring 11 and then removing the coupling shoes 505 and the control arms 501. The coupling shoes 505 and the spring 11 may then be put back and then the connector may be used without control arms 501 instead, as desired.

Figure 10:
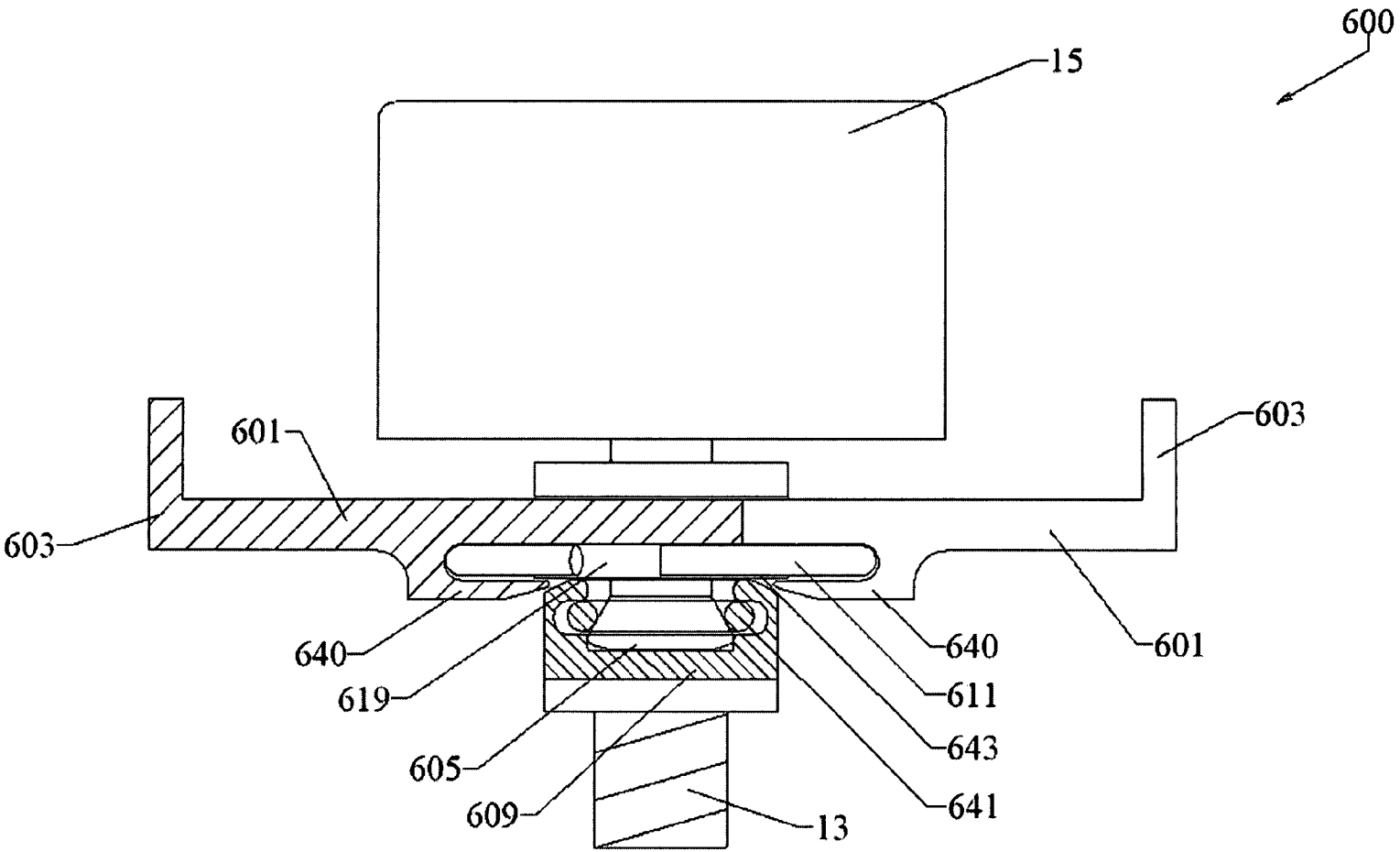
FIG. 10 is a side view of an arrangement with the control arms connected to a connector with a wedge that presses the connector away from the abutment when the handle is pressed and the connector is here inserted in an abutment having a spring to hold the connector.

FIG. 10 is a side view of an arrangement 600 where the control arm 601 is connected to a wedge portion 640 which can be pressed in between the connector plate 619 and the abutment 609 so that the hearing aid 15 may be released from the abutment 609 without exerting a load the fixture 13. The wedge portion 640 may be activated by urging the handles 603 and the arms 601 against the biasing force of the spring 611 so that the portion 605 may be snapped out from the abutment 609 against the biasing force of the spring 641 as the wedge portion 640 penetrates into a wedge-shaped cavity 643 formed between the abutment 609 and the connector plate 619. In this way, there is no need to pull on the fixture 13 that is attached to the skull of the user.

Figure 11:
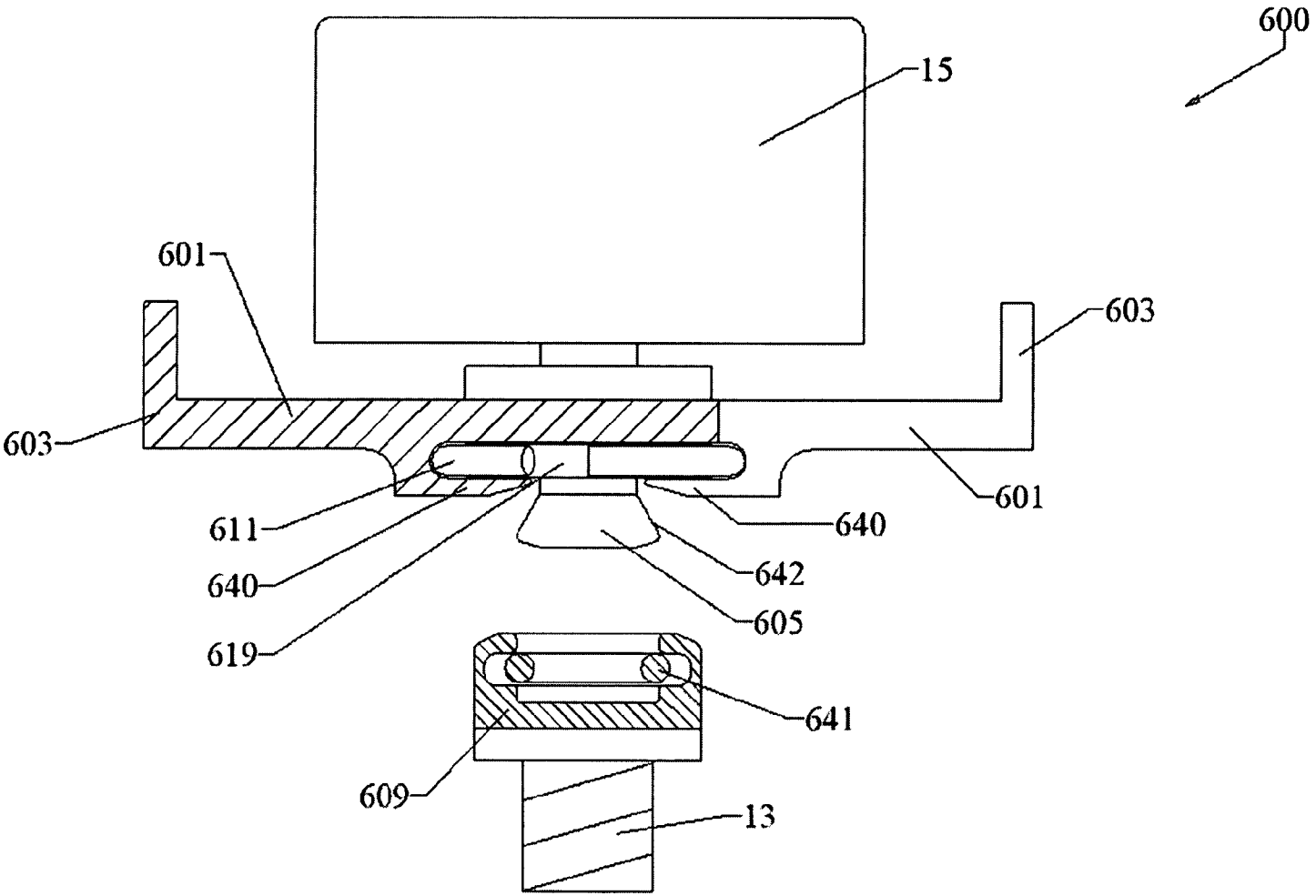
FIG. 11 is a side view of the arrangement shown in FIG. 10 but where the control arms are pressed together and the connector has been disconnected from the abutment.

FIG. 11 is a side view of the arrangement shown in FIG. 10 but where the control arms 601 has been pressed together to activate the wedge portion 640 to disconnect the portion 605 of the connector from the abutment 609. The control arms 601 are urged apart or to be separated by the circular spring 611. This arrangement is here shown together with a connector type that has a spring 641 seated in a grove on the inside of the abutment 609. A coupling shoe 605 is a rigid body that can be snapped into the abutment 609. When the coupling shoe 605 is seated in the abutment 609 the spring 641 presses against a conical portion 642 on the coupling shoe 605 to hold the shoe 605 in place by pressing the connector plate 619 against the abutment 609.

Figure 12:
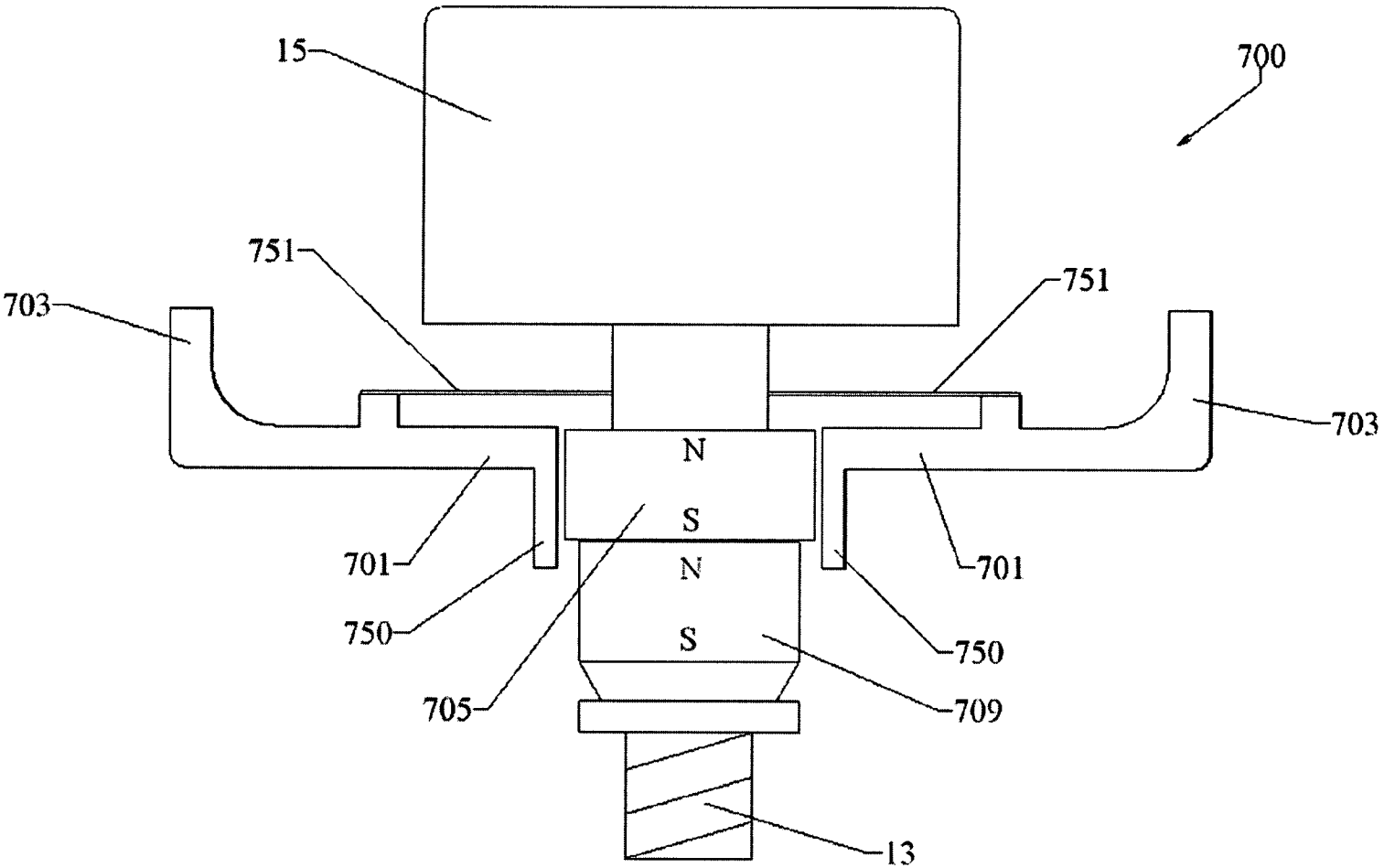
FIG. 12 is a side view of an arrangement where the control arm is connected to a connector sleeve and where the connector and the abutment is connected with a magnetic interaction.
Figure 13:
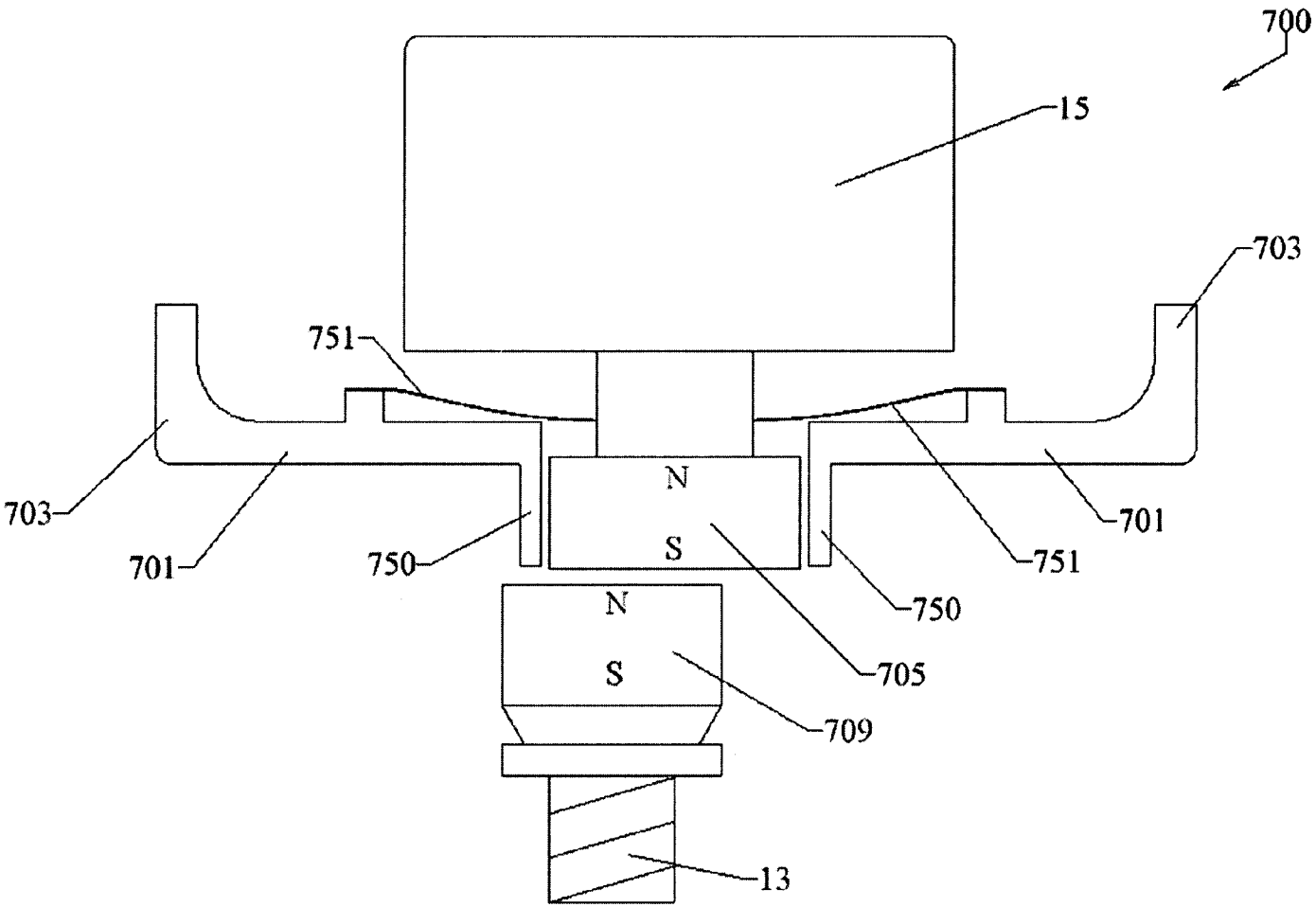
FIG. 13 is a side view of the arrangement shown in FIG. 12 but where the connector sleeve has been moved in lateral direction to allow the connector to be moved sidewise in relation to the abutment.

FIG. 12 is a cross sectional side view of an arrangement where the control arm 701 is connected to a circular connector sleeve 750 and where the connector and the abutment 709 are connected with a magnetic interaction. The connector sleeve 750 is a circular sleeve that extends down around the lateral portion of the abutment 709 and prevents the coupling shoe 705 to slide in a sidewise direction in relation to the abutment 709. This takes advantage of the fact that it is generally relatively easy to slide two magnets relative to one another but difficult to separate the magnets by pulling them apart against the magnetic force. The control arms 701 and the connector sleeve 750 are kept in position by the metal spring plate 751. In this way, the user simply presses the hearing aid 15 against the skull to counter-act the biasing force of the spring plate 751 so that the magnet 705 moves relative to the sleeve 750 until a surface 752 of the magnet 705 is either flush with or extends beyond an outer surface 754 of the sleeve 750, (as best shown in FIG. 13. The user then moves the magnet 705 sideways relative to the magnet 709 until the magnets are separated. This makes it possible to separate the magnets from one another without having to pull the magnets apart against the magnetic forces of the attracting magnets 705, 709.

FIG. 13 is a cross sectional side view of the arrangement shown in FIG. 12 but where the connector sleeve 750 has been moved in a lateral direction away from the abutment 709 to allow the connector to be moved sidewise in relation to the abutment. The connector sleeve 750 is moved in lateral direction by pulling the handles 3 in lateral direction against a biasing force of a spring mechanism 751 at the same time as a counteracting pressure is applied at the lateral side of the hearing aid 15.

Figure 14:
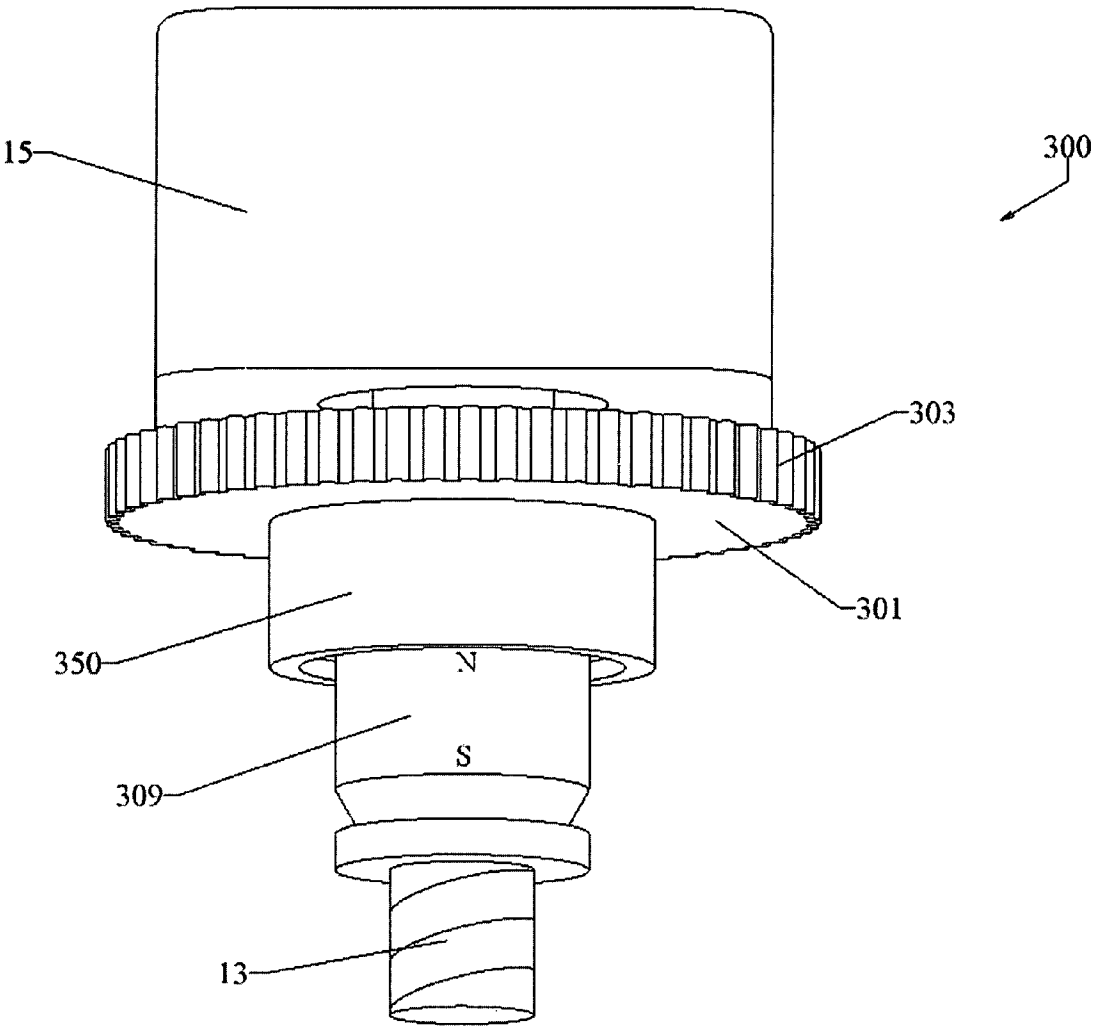
FIG. 14 is a perspective side view of a similar arrangement as the one shown in FIG. 12 but where the control arm has been designed as a turning wheel with a threaded center portion instead of a straight control arm with a spring as in FIG. 12.
Figure 15:
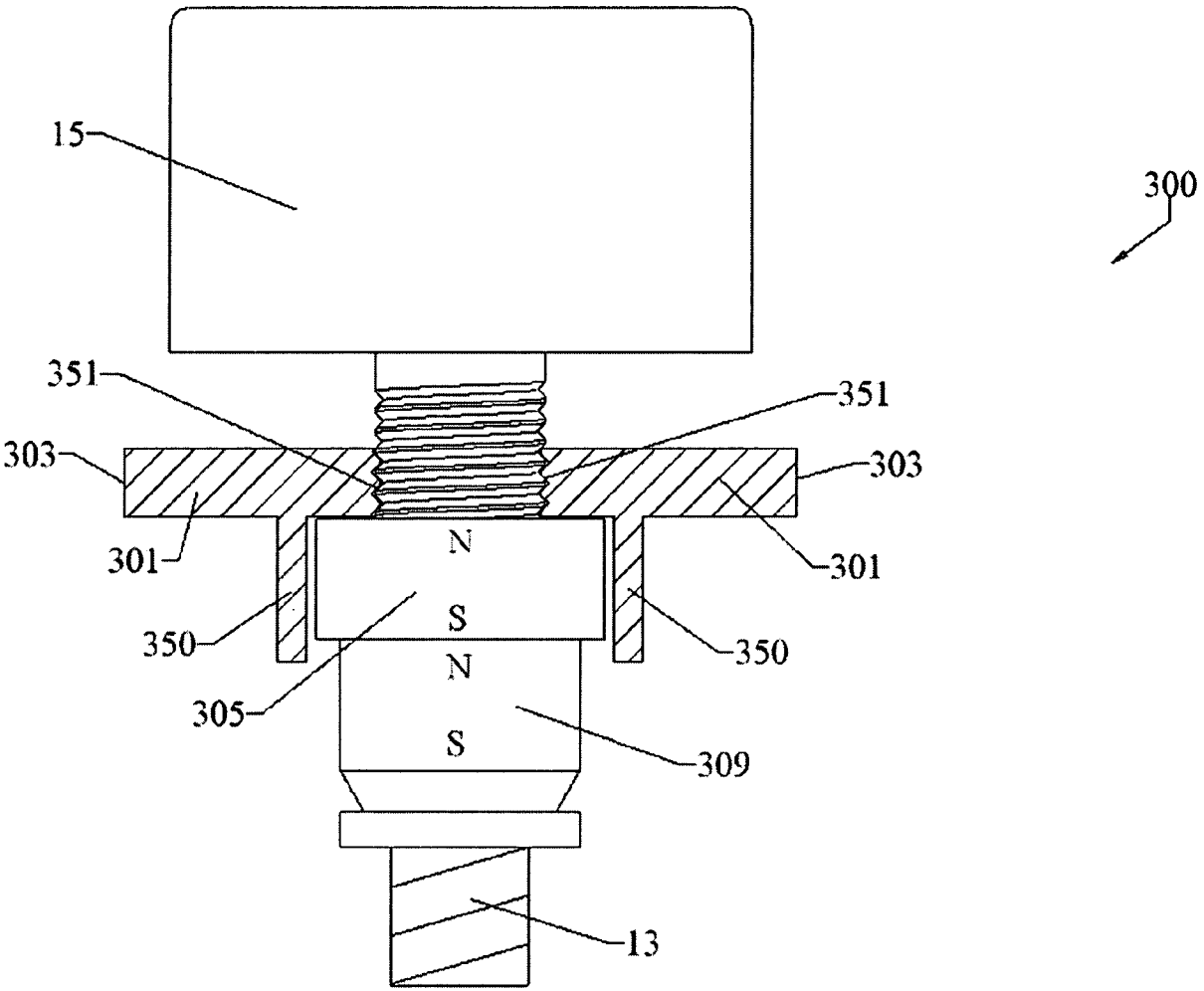
FIG. 15 is a cross sectional side view of the embodiment in FIG. 14.

FIG. 14 is a perspective side view of an alternative design of the arrangement shown in FIG. 12, but here the control arm 301 has been designed as a wheel instead of a straight arm. FIG. 15 is a cross sectional side view of the embodiment in FIG. 14. The control arm 301 has a threaded portion 351 in the center instead of a spring arrangement as in FIG. 12. In this way the connector sleeve 350 can be moved in lateral or contra lateral direction by turning the control arm 301 in either direction. The periphery of the control arm 301 acts as a handle 303 for the patient to control the connection.

For all of the above embodiments several alternative designs and combinations are possible and the invention is not limited to the preferred embodiments presented above. While the present invention has been described in accordance with preferred compositions and embodiments, it is to be understood that certain substitutions and alterations may be made thereto without departing from the spirit and scope of the following claims.

The invention claimed is:

1. An arrangement for controlling the connection of a hearing aid to a fixture anchored in the skull bone, comprising:

a skin penetrating abutment having an outside connected to a connector and an inside connected to a fixture;

a control arm extending from the connector, disposed between the hearing aid and the abutment, to a handle disposed at a side of the hearing aid where the handle is reachable by a patient;

biasing means providing a biasing force for biasing the control arm in relation to the connector;

the control arm being in operative engagement with the connector and movable in a direction to counter-act the biasing force of the biasing means to release the abutment from the connector; and a coupling shoe on the connector, the coupling shoe being in contact with the abutment when the hearing aid is connected to the abutment.

2. The arrangement according to claim 1 wherein the control arm is connected to a flexible coupling shoe on the connector.

3. The arrangement according to claim 1 wherein the control arm is connected to a coupling shoe that is urged against the abutment by a spring.

4. The arrangement according to claim 1 wherein the control arm is in operative engagement with a spring that is biased to press the coupling shoe against the abutment.

5. The arrangement according to claim 1 wherein the arrangement has two control arms that are movable in opposite directions and where the handles are placed at each side of the hearing aid.

6. The arrangement according to claim 1 wherein the control arm is connected to a connector mounted on the hearing aid.

7. An arrangement for controlling the connection of a hearing aid to a fixture anchored in the skull bone, comprising:

a control arm extending from a connector, disposed between the hearing aid and an abutment to a handle disposed at a side of the hearing aid where the handle is reachable by a patient;

biasing means providing a biasing force for biasing the control arm in relation to the connector;

the control arm being in operative engagement with the connector and movable in a direction to counter-act the biasing force of the biasing means to release the abutment from the connector;

a coupling shoe on the connector, the coupling shoe being in contact with the abutment when the hearing aid is connected to the abutment; and at least one of the abutment and the coupling shoe having a permanent magnet so that the control arm is connected to a coupling shoe that is urged against the abutment by a magnetic interaction between the connector and the abutment.

8. The arrangement according to claim 7 wherein the control arm is connected to a connector sleeve that encloses a magnet.

9. An arrangement for controlling the connection of a hearing aid to a fixture anchored in the skull bone, comprising:

a control arm extending from a connector, disposed between the hearing aid and an abutment to a handle disposed at a side of the hearing aid where the handle is reachable by patient;

biasing means providing a biasing force for biasing the control arm in relation to the connector;

the control arm being in operative engagement with the connector and movable in a direction to counter-act the biasing force of the biasing means to release the abutment from the connector;

a coupling shoe on the connector, the coupling shoe being in contact with the abutment when the hearing aid is connected to the abutment; and the control arm having a wedge portion that increases a distance between the coupling shoe and the abutment when a force is applied on the handle.

10. An arrangement for controlling the connection of a hearing aid to a fixture anchored in the skull bone, comprising:

a control arm extending from a connector, disposed between the hearing aid and an abutment to a handle disposed at a side of the hearing aid where the handle is reachable by a patient;

biasing means providing a biasing force for biasing the control arm in relation to the connector;

the control arm being in operative engagement with the connector and movable in a direction to counter-act the biasing force of the biasing means to release the abutment from the connector;

a coupling shoe on the connector, the coupling shoe being in contact with the abutment when the hearing aid is connected to the abutment; and the control arm being connected to a connector mounted on a healing interconnection unit.

11. The arrangement according to claim 10 wherein the arrangement has a healing cap with an abutment and wherein both the abutment and a lateral side of the healing cap have an interface which is connectable to the connector, and the contra lateral side of the healing cap is connectable to the abutment.

12. The arrangement according to claim 10 wherein the arrangement has a healing cap and an abutment and wherein the abutment is accessible through the healing cap.

13. The arrangement according to claim 10 wherein the control arm is connected to a coupling shoe and wherein the abutment has a spring to hold the coupling shoe against the abutment.

14. The arrangement according to claim 10 wherein the abutment has a cavity for receiving a protruding portion of the connector.

15. An arrangement for controlling the connection of a hearing aid to a fixture anchored in the skull bone, comprising:

a control arm extending from a connector, disposed between the hearing aid and an abutment to a handle disposed at a side of the hearing aid where the handle is reachable by a patient;

biasing means providing a biasing force for biasing the control arm in relation to the connector; the control arm being in operative engagement with the connector and movable in a direction to counter-act the biasing force of the biasing means to release the abutment from the connector;

a coupling shoe on the connector, the coupling shoe being in contact with the abutment when the hearing aid is connected to the abutment; and the control arm having an arm interconnection so that the control arm is separatable from the connector.

16. A hearing aid arrangement, comprising:

a hearing aid having a connector; a lateral connector for connecting to the connector of the hearing aid and a contra lateral connector;

an abutment connected to a fixture, the abutment being adapted to be connected to the contra lateral connector; and a control arm in operative engagement with the contra lateral connector for releasing the contra lateral connector from the abutment when the control arm is biased against a biasing means.

17. The hearing arrangement according to claim 16 wherein the control arm is a wheel that is movable to control the connector.

* * * * *